US006197178B1

(12) United States Patent
Patel et al.

(10) Patent No.: US 6,197,178 B1
(45) Date of Patent: Mar. 6, 2001

(54) METHOD FOR FORMING CERAMIC COATINGS BY MICRO-ARC OXIDATION OF REACTIVE METALS

(75) Inventors: Jerry L. Patel, Peabody; Nannaji Saka, Cambridge, both of MA (US)

(73) Assignee: Microplasmic Corporation

( * ) Notice: Subject to any disclaimer, the term of this patent is extended or adjusted under 35 U.S.C. 154(b) by 0 days.

(21) Appl. No.: 09/285,604

(22) Filed: Apr. 2, 1999

(51) Int. Cl.[7] ..... C25D 11/02; C25D 21/12

(52) U.S. Cl. ..... 205/81; 204/230.2; 205/96; 205/107; 205/137; 205/145; 205/321; 205/322; 205/324; 205/325; 205/326

(58) Field of Search ..... 205/81, 82, 83, 205/96, 107, 137, 145, 320, 321, 322, 324, 325, 326, 328; 204/229.8, 230.2

(56) References Cited

U.S. PATENT DOCUMENTS

| | | | | |
|---|---|---|---|---|
| 3,361,654 | * | 1/1968 | Deprez et al. | 205/528 |
| 3,531,392 | * | 9/1970 | Schmeiser | 204/225 |
| 3,824,159 | | 7/1974 | Wehrmann | 205/108 |
| 3,862,892 | | 1/1975 | Lautenshlager et al. | 205/50 |
| 3,900,373 | * | 8/1975 | Ralston, Jr. | 205/337 |
| 3,956,080 | | 5/1976 | Hradcovsky et al. | 205/316 |
| 4,149,912 | | 4/1979 | Craighead et al. | 148/285 |
| 4,659,440 | | 4/1987 | Hradcovsky et al. | 205/106 |
| 4,789,441 | | 12/1988 | Foster et al. | 205/50 |
| 5,064,788 | | 11/1991 | Newkirk et al. | 501/92 |
| 5,158,663 | | 10/1992 | Yahalom | 205/50 |
| 5,275,713 | * | 1/1994 | Hradcovsky | 205/106 |
| 5,385,662 | | 1/1995 | Kurze et al. | 205/316 |
| 5,427,678 | | 6/1995 | Masahiro et al. | 205/322 |
| 5,616,229 | | 4/1997 | Samsonov et al. | 205/107 |
| 5,700,366 | | 12/1997 | Steblianko et al. | 205/87 |
| 5,720,866 | | 2/1998 | Erokhinc et al. | 205/83 |
| 5,766,489 | | 6/1998 | Weinzierl et al. | 210/748 |

OTHER PUBLICATIONS

V. N. Malyshev et al, 'Features of the Structure and Properties of Coatings Applied by the Method of Microarc Oxidation', Khimicheskoe i Neftyanoe Mashinostroenie, No. 1, pp. 26–27, Jan. 1984.*

J.M. Kape, 'Hard Anodizing Processes', presented at seminar 'Hard Anodizing of engineering Components' held at Stonehous, Glas., U.K. on May 27–28, 1987, pp. 1–7.*

A. P. Efremov et al, 'Special Features of Formation of the Oxide Layer on Aluminum in Microarc Oxidation . . . ', Fiziko–Khimicheskaya Mekhanika Materilov. vol. 25, No. 3, pp. 46–49, May–Jun. 1989.*

P.S. Gordienko et al, 'Kinetics of Formation of Microarc Oxidation Coatings on Aluminum Alloys', Zashchita Metallov, vol. 26, No. 3, pp. 467–470, May–Jun. 1990.*

V. N. Kuskov et al, 'Special features of growth of the coating in microarc oxidation of Aluminum Alloys', Physics and Chemistry of Materials Treatment, 1991 25 (5) pp. 580–582, 1991, month not available.*

V. N. Kuskov et al, 'Phase composition and microhardness of coatings produced by microarc oxidation', Fizka i Khimlya Obrabotld Materialov. vol. 24, No. 6, pp. 101–103, 1990, month not available.*

(List continued on next page.)

*Primary Examiner*—Kathryn Gorgos
*Assistant Examiner*—William T. Leader

(57) ABSTRACT

A process and apparatus for forming oxide coatings on bodies of aluminum and aluminum alloys are described. The process includes forming an electrolyte bath in an inert container. At least two reactive metal bodies are suspended in the bath. The bodies are connected to electrodes which, in turn, are connected to a multiphase AC circuit. A multiphase power (preferably three-phase between three bodies) potential is imposed between each of the bodies. The bodies are moved in the electrolyte bath relative to each other until micro-arcs occur on the surfaces of the bodies, whereby to commence oxidation of the bodies. The imposition of the potential between each of the bodies is continued until the desired thickness of oxide is formed on the bodies.

30 Claims, 2 Drawing Sheets

OTHER PUBLICATIONS

A. V. Timoshenko et al, 'Microarc Oxidation of D16T Alloy with Alternating Current in an Alkali Electrolyte', Zashchita Metallov, vol. 27, No. 3, pp. 417–424, May–Jun. 1991.*

V.A. Fedorov et al, 'Formation of hardened surface layers by microarc oxidation in different electrolytes and different current conditions', Physics and Chemistry of Materials Treatment, 1991 25 (1), pp. 67–71, 1991, month not available.*

V.P. Alekhin et al, 'Special features of the microstructure of hardened surface layers produced by microarc oxidation', Physics and Chemistry of Materials Treatment, 1991 25 (5), pp. 555–559, month not available.*

Wayne Grinthal et al, 'Surfaces: More Than They Seem,' Chemical Engineering, vol. 101, No. 4, pp. 35, Apr. 1994.*

A.A. Petrosyants et al, 'Wear Kinetics of Coatings Deposited by Microarc Oxidation', Trenie i Iznos, vol. 5, No. 2, pp. 350–354, 1984, month not available.*

V. O. N. Rao et al, 'Friction and Wear Characteristics of Micro–Arc Oxidation Coating' Society of Automotive Engineers, Inc., pp. 91–105, 1997, month not available.*

V.S. Rudnev et al, 'Effect of the Electrolyte on the result of Microarc Oxidation of Aluminum Alloys', Zaschita Metallov, vol. 27, No. 1, pp. 106–110, Jan.–Feb. 1991.*

* cited by examiner

METHOD FOR FORMING CERAMIC COATINGS BY MICRO-ARC OXIDATION OF REACTIVE METALS

BACKGROUND OF THE INVENTION

1. Field of the Invention

The present invention relates to methods of coating a metal substrates to improve tribological (friction and wear) thermal, chemical and electrical properties of the metal substrates and especially to methods of forming ceramic coatings on the metal substrates.

2. Description of the Prior Art

The practice of coating a metal substrate with a thin layer of a ceramic material has been used commercially for many years. One purpose of providing a ceramic coating of a metal is to improve the wear resistance of the metal from abrasion and another purpose is to protect the surface of the metal from thermal degradation, oxidation, or corrosion. In particular, research and development activity has been carried out throughout the world to provide superior surface properties to metals such as aluminum and aluminum alloys. Aluminum and aluminum alloys are extremely desirable metals for manufacturing machinery components and the like because they are relatively inexpensive and have relatively low densities. Aluminum and aluminum alloys, however, have the drawbacks of being relatively soft and do not resist wear and abrasion very well. In addition, aluminum is chemically active so that it tends to react with chemicals and even moisture in the air, thereby corroding.

A known method of improving the surface of a substrate of aluminum or an alloy of aluminum is to apply a ceramic coating to the substrate by spraying the ceramic coating onto the substrate. Typically, the process of "flame spraying" includes a wire-type flame sprayer. The protective coatings applied in this manner are limited to those materials which can be formed into a wire or rod.

Commercially available spray guns now permit the use of a wide variety of metals, alloys, ceramics, and cermets which can be ground into a relatively fine powder to coat the substrate. Before coating the substrate, the surface of the substrate is subjected to cleaning, under-cutting, and blasting to achieve good adhesion. The flame-spray gun utilizes combustion or a plasma flame to produce sufficient heat to melt the coating material. An electric arc or resistance here can also be used for generating the necessary heat. The carrier gas for the powder can be oxygen or even an inert gas such as nitrogen. In a plasma spray gun, the primary plasma gas is usually an inert gas such as nitrogen or argon.

Coatings of aluminum and alloys of aluminum are of particular interest as a thermal barrier in the rocket and jet engine field. Coatings for this intended use are designed to be somewhat porous in order to resist the high thermal shock encountered and to improve their effectiveness as thermal barriers. Therefore, these coatings are different from the fused coatings of low melting ceramics which are classed as vitreous enamels, and they must be applied over base materials if they are to be exposed to high temperatures and oxidizing atmospheres.

Ceramic coatings used in the prior art are generally inherently porous and ordinarily do not provide much oxidation or corrosion protection to the base material. Thus, undercoats made from oxidation-resistant materials, or alloys are used between the base material and the ceramic coating if the substrate material is not corrosion resistant.

Ceramic coatings containing aluminum oxide are used for wear protection because aluminum oxide is well known to have high abrasion resistance. Flame sprayed ceramic coatings containing refractories, such as zirconium oxide, are frequently used for thermal barrier protection of metal subjected to high temperatures. The zirconium oxide usually contains some hafnium oxide and other impurities and can be stabilized with calcium oxide or yttrium oxide.

Typically, one class of ceramic coatings has high thermal resistance and a low wear resistance, while another class of ceramic coatings has a high wear resistance and has a low thermal resistance. The general reason for this relationship is that ceramic coatings which have a high thermal resistance typically are more porous and have a higher void content thereby providing a good thermal barrier but also being less resistant to abrasion. A ceramic coating having a high abrasion resistance has a low void content, thus reducing damage to abrasion. Furthermore, in the prior art, only one specimen is connected to one electrode and the other electrode is connected to the electrolyte tank. Primarily, the power source was single phase AC and DC power.

Although the flame-spray process is widely used, the drawbacks in the process have motivated world wide research into providing a different process for producing materials with improved properties. One area of research is the microarc oxidation of aluminum and its alloys to produce an oxide compound having very high hardness, good wear resistance, and excellent bonding strength with the metallic substrate.

The prior art microarc oxidation processes have been divided into two basic groups. One group is an anodic group on which the substrate is the anode during the process. The other group is the cathodic process in which the substrate is the cathode.

Many techniques have been proposed to form protective ceramic coatings on reactive metals, especially metals such as aluminum and its alloys. One technique was to form such coatings with electrochemical reactions between the metal and an electrolyte solution whereby an oxide coating was formed on the surface of the metal. Such processes involve acid or alkaline based electrolytes. Various techniques were disclosed for establishing a potential whereby the oxide coatings were formed. A class of electrolytic coating methods is micro-arc or microplasmic oxidation. In micro-arc oxidation, the metal is subjected to a high electrical current density while the metal is submerged in an electrolyte bath. Electrical discharges on the surface of the substrate form adherent oxide coatings. Notable among micro-arc oxidation processes is one whereby the potential is pulsed for short periods of time, between 1 to 5 seconds "on" and 1 to 5 seconds "off". While the process produced oxide coatings on the metal substrate it took a considerable period of time, frequently between 5 and 16 hours, to produce a coating between about 50 and 300 microns. The equipment needed to produce such coatings also was complicated and expensive to construct and to operate.

Typically, a substrate of aluminum is subjected to a high electrical current density while submerged in an electrolyte containing a water soluble silicate such as sodium silicate and caustic potash as disclosed in the article entitled, "Special Features of Growth of the Coating in Microarc Oxidation of Aluminum Alloys" by V. N. Kuskov, Yu. N. Kuskov, I. M. Kovenskii, "Physics and Chemistry of Materials Treatment", 1991 25 (5) pp 580–582. The article reports the use of different electrical current densities and the hardness in the coatings over the range tested. This art is also referred to as "microplasmic technology". As used herein, the term "electrical current density" refers to the ratio of the electrical current communicated to a substrate during the process to the exposed surface area of the substrate. The prior art microarc oxidation processes produced good ceramic type coatings but these coatings are limited with respect to the minimum thickness attainable. In addition, the prior art processes did not provide a high degree of control as to the physical qualities of the coatings obtain with respect to selectively achieving good thermal properties or good mechanical properties. Moreover, the prior art has not identified optimum system or the conditions for efficiently operating a system for carrying out the microarc process to obtain superior coatings.

Accordingly, it can be seen that a need exists for a system and an effective process for producing a protective coating or layer on a metal substrate such as aluminum and aluminum alloys.

SUMMARY OF THE INVENTION

The present invention relates to an electrochemical, microplasmic oxidation process for forming tenacious, stable oxide coatings on the bodies of reactive metals, reactive metal alloys, intermetallic compounds and reactive metal-matrix composites. The process includes forming an electrolytic bath which can be either acidic or basic, but preferably is basic, in a nonreactive container. At least two metallic bodies, and preferably three metallic bodies, are attached to individual electrodes and immersed in the bath. The electrodes are attached to an AC power supply, preferably three electrodes are attached to a three-phase AC power supply. While in the electrolyte, a potential is imposed between each of the bodies. Preferably, the potential is at least about 400 volts with a current density greater than 10 $A/dm^2$ (amps/square decimeter) and preferably between about 10 and 70 $A/dm^2$. The bodies are moved towards each other within the bath until micro-arcs form on the surface of the bodies. They are then further moved relative to each other to control current and current density. The formation of the micro-arcs occurs on the surfaces of the bodies when they are moved into correct positions relative to each other as evidenced by a sharp flash of light. The imposition of the potential between the bodies is continued until the desired thickness of oxide has been formed thereon. In general, thickness between 50 and 130 microns can be formed on the bodies within 20 to 40 minutes using a potential of 480 volts and a current density of 10 to 70 $A/dm^2$ (amps/square decimeter).

In the case where acid electrolyte baths are used commonly they contain sulfuric acid, nitric acid, hydrochloric acid, phosphoric acid, chromic acid, oxalic acid, and combinations thereof. If alkaline baths are used they contain metal hydroxides, such as sodium, potassium, calcium or magnesium, are used together with metal silicates and aluminates to reduce porosity, improve surface finish and improve corrosion resistance. In those cases the pH of the bath should be between about 8 and 13. In all cases the concentrations of the materials added to the bath are quite dilute, between about 1 and 10 gms. per liter.

In operation of the process, a sinusoidal AC potential provided by the electric utility is established between the bodies to be coated while they are immersed in an electrolytic bath. We found the bodies to be coated produced coatings only during the anodic periods of the AC sine wave since, in a two-body coating system, the anodic phase switches back and forth between the two bodies and the coating will be produced on both bodies. Advantageously, however, we use a three-phase system in which three bodies are immersed in the electrolytic bath and the three-phase current is applied to each, serially moving from one anode to another.

Through the steps herein described, it was possible to coat aluminum samples to a predetermined thickness in a few minutes per sample rather than many hours, thereby significantly reducing the time for coating. Moreover, the cost of the electrolyte was significantly reduced by using dilute solutions rather than the concentrated solutions of the prior art.

Furthermore, the present invention involves inexpensive equipment for conducting such electrochemical operations. The equipment includes an inert coating tank to hold the electrolyte. The coating tank is fitted in an outer tank and a heat exchange medium is placed in the outer tank. Electrolyte can be withdrawn from the coating tank and circulated through an inert heat exchanger placed in an outer tank. Preferably, another heat exchanger is disposed outside the outer tank to cool the heat exchange medium. Other heat-exchange mechanisms can also be used, such as remote heat exchanger which cycle the electrolyte or coolant and keep the temperature within process limits. All of the processing temperatures can be monitored with associated thermocouples.

An array of electrodes is suspended over the coating tank and immersed in the electrolyte to hold the bodies to be coated. Simple screw threads can be disposed at the ends of the electrodes to fit into mating fittings in the bodies. Each of the electrodes is independently and laterally movable by a remote control device. The electrodes are connected to a source of AC power, preferably three electrodes are connected to a three-phase AC power supply. Preferably the electrodes are also rotatable to allow oscillation or rotation of the workpieces so coatings of uniform thickness can be provided on each body. Changes of the current are monitored since they reflect changes in resistance whereby to monitor increases in the thickness of the oxide coating. Alternatively, changes in emission color of said bodies in the bath can be monitored since they too reflect the thickness of said oxide coating, that is when the emission dims the micro-plasmic reaction has ceased since the oxide layer has become insulating and the reaction has ceased. Of course, the bodies can be moved closer to each other to commence the reaction anew, but the bodies must not touch and short circuit.

Oxidation can include such reactive metals as Al, Mg, Ti, V, W, Zn and Zr and binary reactive metal alloys such as Al—Cu, Al—Si, Al—Ti, Al—V, Al—Zn, Al—Zr, Mg—Zn. Also, multi-component reactive metal alloys such as Al—Cu—Zn, Al—Cu—Mg, Al, Mg—Si can be oxidized along with the reactant metal, intermetallic compounds such as NiAl, $Ni_3Al$, FeAl, TiAl or reactive metal composites such as Al—$Al_2O_3$, Mg—$Al_2O_3$, Ti—$Al_2O_3$.

An object of the present invention is to provide an oxide coating on reactive metals or metal alloys through microplasmic oxidation.

Another object of the present invention is to reduce costs and process time associated with electrolytic oxidation of metals and alloys by reducing the quantities of chemicals in the electrolyte solution.

A feature of the present invention is the connection of metal bodies to be coated to an AC power supply and forming a circuit between the bodies to oxidize the metal through microplasmic oxidation.

An advantage of the present invention is that the three-phase 480 V AC electrical service supplied by the electric utility can be used to connect directly to the bodies being treated.

Another advantage of the present invention is that the bodies can be oxidized quickly, thereby substantially reducing power costs and process time.

A further advantage of the present invention is that dilute solutions can be used as the electrolyte, thereby providing considerable cost savings on chemicals.

The many other objects, features and advantages of the present invention will become apparent to those skilled in the art upon reading the following specification when taken in conjunction with the accompanying drawings.

DESCRIPTION OF THE PREFERRED EMBODIMENT

Figure 1:
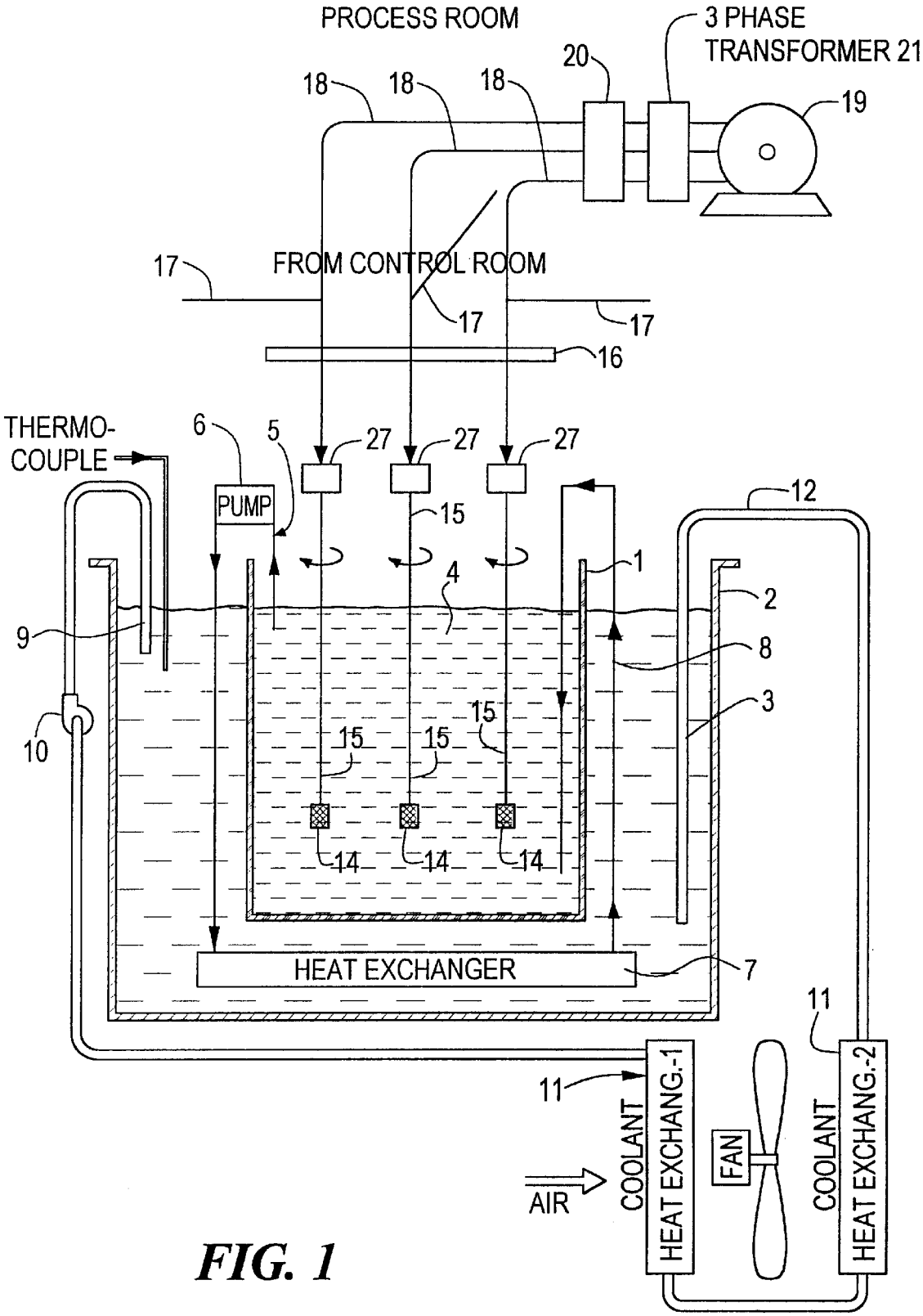
FIG. 1 is an elevational view partially in cross section of the processing equipment for the production of hard oxides on workpieces according to the present invention.

Referring now to FIG. 1, an chemically inert coating tank 1 is disposed within an outer tank 2. Outer tank 2 contains heat-exchange fluid 3, preferably conventional antifreeze. Electrolyte 4 is held in coating tank 1. To recirculate and keep the desired temperature of electrolyte 4 (below 80° C.) during microplasmic oxidation, the electrolyte is withdrawn from tank 1 through pipe 5 by pump 6. From pump 6 the electrolyte is circulated through heat exchanger 7 which is disposed within outer tank 2. From heat exchanger 7 the electrolyte is passed through outlet pipe 8 and back into coating tank 1. To remove heat from the heat exchange fluid 3, heat exchange fluid 3 is withdrawn from outer tank 2 through pipe 9 by pump 10. The heat-exchange fluid is then passed through a forced air cooled heat exchanger 11 to return via outlet pipe 12. The operation of each of the exchanger 7 and 11 can be controlled automatically so as to maintain the desired temperature within the electrolyte bath.

Bodies 14 which are to be coated are suspended within electrolyte solution 4 on electrodes 15. Electrodes 15 are electrically conductive and are insulated to render the exterior surfaces thereof electrically inert. Electrodes 15 are suspended from a bracket 16. Electrodes 15 are preferably disposed in a triangular array and can be moved in any direction relative to each other by remote controlled actuators 17. Electrodes 15 are connected to flexible wires 18 which in turn are connected to a three-phase generator 19 or to a three-phase 480 V AC power supply. A circuit breaker 20 is disposed between generator 19 and bodies 14 to terminate the process or disable the imposition of a potential between bodies 14 if a short circuit occurs. Electrodes 15 are rotated, as desired, by remotely controlled motors 27 so that all sides of bodies 14 can be evenly coated during the process. A three-phase transformer 21 maintains the desired potentials.

Figure 2A:
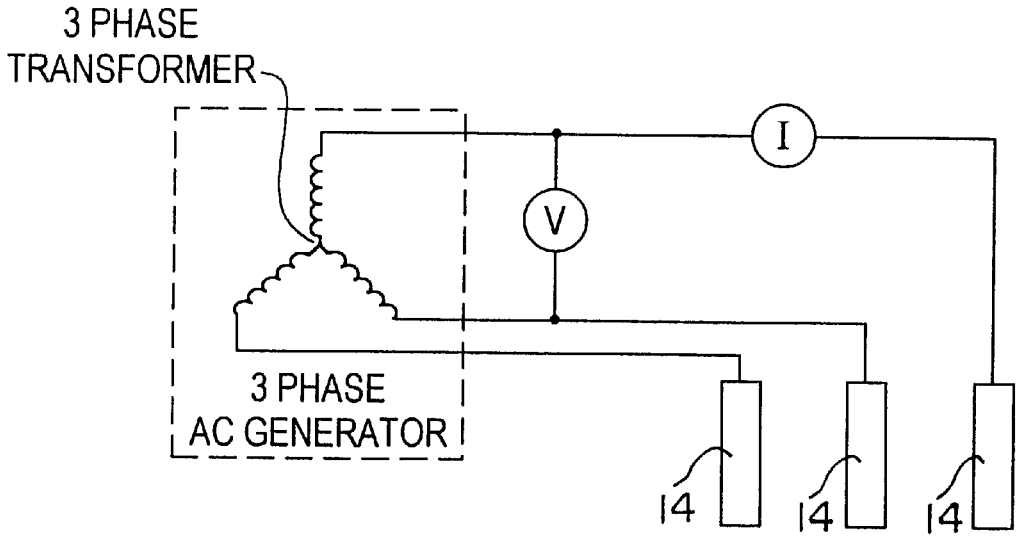
FIG. 2*a* is a schematic illustration of the electric circuit used in the present invention.
Figure 2B:
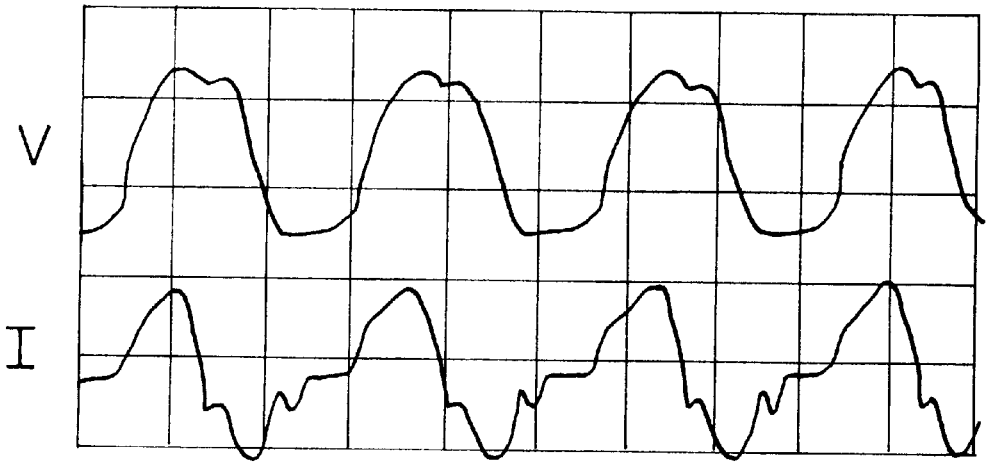
FIG. 2*b* is a view of the waveforms produced on an oscilloscope illustrating the voltage and current during operation of the process.

In operation, the bodies 14 are suspended within the tank 1. A three-phase AC potential from a three-phase power supply is imposed between the three bodies 14. The bodies are disposed within an electrolyte bath. In FIG. 2*a*, the electrical connections for three-phase operation are shown. Essentially a single specimen was connected to each electrode and the electrodes were in turn connected to the output terminals of a three-phase generator. In FIG. 2*b* the oscilloscope traces of voltage and current are shown. The upper trace represents the voltage (V) and the lower trace the current (I). While the supply voltage was pure sinusoidal, i.e., without waveform distortion, the voltage across the electrodes while the process was in progression was slightly distorted. By contrast, the current waveform has higher harmonics. As the supplied sinusoidal voltage raises from zero to a maximum, the current does not follow the voltage signal. For a short time the current is zero. This is due to the fact that a certain minimum voltage is required for the current to break through the oxide film. This voltage may be called threshold voltage. Once the film is broken though, the current signal rises in unison with the voltage across the electrodes. As the voltage falls from the peak value, the current too falls. However, the current falls to zero sooner than the voltage due to the threshold effect. It may be noted that the specimens become oxidized during the positive half-cycle of the supplied voltage. During the negative half-cycle the oxide film is sintered and consolidated to form an adherent dense coating to bond with the substrate. The true oxidation time per cycle, however, is only a half of the half-cycle time.

Similar observations have been made with single-phase operation also. The primary difference, however, is that in the single-phase operation the voltage and current will be in phase whereas in the three-phase operation they will be slightly out of phase.

Electrolyte Preparation (1) Deionized water
(2) Chemicals:

Process A

Two gms. per liter of each of the following chemicals.

KOH—Potassium hydroxide $Na_2SiO_3.5H_2O$—Sodium silicate (Sodium metasilicate penta hydrate)

$Na_2O.Al_2O_3.3H_2O$—Sodium aluminate (Aluminum sodium oxide)

Process B

Deionized water plus 10.0 gms per liter of $Na_2SiO_3.5H_2O$.

Process C

Deionized water plus 1 to 10 gms. per liter of each of the following chemicals.

KOH—Potassium hydroxide $Na_2SiO_3.5H_2O$—Sodium silicate (Sodium metasilicate pentahydrate)

$Na_2O.Al_2O_3.3H_2O$—Sodium aluminate (Aluminum sodium oxide)

Each of the chemicals described above is separately dissolved in the deionized water prior to mixing the solutions together. The pH of each of the mixed electrolyte solutions is between 12 and 13.

The temperature of the electrolyte bath 4 is maintained between about 25 and 80° C. In the herein disclosed system, a potential between bodies 14 is maintained between about 400 and 600 volts. It is important to the process to maintain the correct current density between the bodies to be coated. The correct current density between the bodies is accomplished by moving the bodies relative to each other to initially commence the microplasmic discharge and then maintain the correct current density by monitoring the current and moving the bodies relative to each other during the operation of the process. We have found that current densities between 20 and 70 A/dm$^2$ result in effective coatings occurring between about 20 and 40 minutes. The current density can also be controlled by varying the potential with transformer 21.

The invention will be further explained in conjunction with the following examples which are illustrative of the invention and should not be construed to limit the scope thereof.

In the examples that follow, all specimens employed in the microplasmic oxidation process were made of heat-treated Al 6061 alloy. After the specimens were turned on a lathe by the common machining processes to a cylindrical form, the specimens were cleaned with an ammonia solution followed by degreasing with isopropyl alcohol and warm water before being subjected to the oxidation process. The AC electrical power supplies were three-phase and single-phase as described below. The electrolyte comprised two compositions. For process A, 2 g. per liter each of potassium hydroxide, sodium silicate, and sodium aluminate was used. For process B 10 g. per liter of sodium silicate was used. It may be understood that these electrolyte compositions are typical and are by no means the only ones to be employed for obtaining dense hard coatings. As described earlier, several compositions of a variety of relative proportions of the chemicals can be used. In most instances satisfactory coatings of varying thickness and hardness and corrosion resistance can be produced by adjusting the composition of the electrolyte. Thus the compositions cited here are by no means restricted by the patent claims.

After connecting the specimens to the electrodes, the electrodes were supplied with three- or single-phase AC power source, usually by a three-phase power supplied by an AC generator set or by the electrical utility and by a transformer. The separation between the electrodes was varied during the tests so that intense, uniform microplasma enveloped the specimens and was sustained during the microplasmic oxidation process. When a satisfactory electrode separation was achieved, the electrodes were held fixed for the duration of the test. The time elapsed before the termination of the test was usually 30 minutes, although the plasma oxidation could be continued beyond this time. The thickness of the coatings was in the range 100 to 160 microns and the hardness of the coatings was 1200–1400 kg/mm$^2$ Vickers.

The following four examples illustrate the versatility of the process. The first example describes the coating method using a three-phase power source and the electrolyte composition prescribed for process A. Examples 2 and 3 describe the coating method using the bath composition for process A, by single-phase AC power supply. Finally, example 4 describes the method of coating using the electrolytic bath composition for Process B and using a single-phase AC power.

EXAMPLE 1

Three cylindrical specimens each 2.5 cm in diameter and 14 cm long were connected to a three-phase AC power supply. The center-to-center distance between the electrodes was kept at 5 cm. The total area of each cylindrical sample was 69 cm$^2$. The applied voltage was 440 V and the current density based on a single sample was 24 A/dm$^2$. The composition of the electrolyte was that of process A. The process was allowed to run for 30 minutes. At the end of the process, the electric power was switched off, the specimens were disconnected from the electrodes, removed from the electrolyte tank, cleaned with warm water and were dried with warm air. The average thickness of the oxide coating on the curved surface was measured to be 125 microns.

EXAMPLE 2

In this test, two cylindrical specimens of dimensions listed above were used, but now they were connected to a single-phase AC electrical power supply provided by a transformer. The center-to center distance of the two specimens was kept at 7.5 cm. The total area of each sample was 69 $cm_2$. The applied single-phase voltage was 465 V and the current density was maintained at 37 A/dm$^2$. The composition of the electrolytic bath was that of process A. After the application of the voltage, a microplasmic glow formed. The test was run for 30 minutes. At the end of the process the single-phase electric power was switched off, the specimens were disconnected from the electrodes, removed from the electrolyte tank, cleaned with warm water and were dried with warm air. The average thickness of the oxide coating on the curved surface was measured to be 115 microns.

EXAMPLE 3

In this test, smaller cylindrical specimens were used. The composition of the electrolytic bath was that of process A. The specimens were 2.5 cm in diameter and 4.5 cm long. The center to center distance of the specimens was kept at 4.5 cm. The total area of each cylindrical specimen was 45 cm$^2$. The applied single-phase voltage was 492 V and the current density was maintained at 34.5 A/dm$^2$. After the application of the voltage, microplasmic glow had formed. The test was run for 30 minutes. At the end of the process the single-phase electric power was switched off, the specimens were disconnected from the electrodes and were removed from the electrolyte tank, cleaned with warm water and were dried with warm air. The average thickness of the oxide coating on the curved surface was measured to be 125 microns.

EXAMPLE 4

For this test, the electrolyte composition a was that of process B. Two cylindrical specimens each 2.5 cm in diameter and 7.5 cm long were connected to a single-phase AC power supply. The center-to-center distance between the electrodes was kept at 5.0 cm. The total area of each cylindrical sample was 69 cm$^2$. The applied voltage was 490 V and the current density based on the area of a single sample was 41.3 A/dm$^2$. The process was allowed to run for 30 minutes. At the end of the process the electric power was switched off, the specimens were disconnected from the electrodes, removed from the electrolyte tank, cleaned with warm water and were dried with warm air. The average thickness of the oxide coating on the curved surface was measured to be 160 microns.

The following is a table of various aluminium alloys with their compositions which were oxidized according to the process of the present invention. In each case, thick, strong adherent coatings were achieved.

| Wt. % | A | B | C | D | E | F | G |
|---|---|---|---|---|---|---|---|
| Mg | 0.1 | 0.4 | 1.5 | 1 | 0.68 | 2.5 | 2.5 |
| Cu | 2–3 | 4.4 | 4.5 | 0.25 | 0.10 | | 1.5 |
| Fe | 1.3 | | | 0.7 | 0.35 | | |
| Mn | 0.5 | 0.8 | 0.6 | 0.15 | 0.10 | | |

-continued

| Wt. % | A | B | C | D | E | F | G |
|---|---|---|---|---|---|---|---|
| Si | 9.5–11.5 | 0.8 | | 0.6 | 0.4 | | |
| Zn | 3.0 | | | 0.25 | 0.10 | | 5.5 |
| Ti | | | | 0.15 | 0.10 | | |
| Ni | 0.30 | | | | | | |
| Cr | Sn 0.15 | | | 0.25 | 0.10 | 0.25 | 0.3 |

It is apparent that modifications and changes can be made within the spirit and scope of the present invention. But it is our intention, however, only to be limited by the appended claims.

As our invention we claim:

1. A process for forming oxide coatings on bodies of reactive metals said process comprising;

forming an electrolyte bath in a container;

immersing at least two of said bodies in said bath;

connecting each of said bodies to an electrode connected to a phase of a multiphase AC power supply;

imposing multiphase AC power potential between each of said bodies and establishing a microplasmic discharge on the bodies through the imposition of a power potential between the bodies, wherein the discharge is initiated by moving said bodies in said electrolyte bath relative to each other until micro-arcs occur on the surfaces of said bodies; and continuing the imposition of the potential between each of said bodies until the desired thickness of oxide is formed on said bodies.

2. The process according to claim 1 wherein the bodies are formed of aluminum and/or aluminum alloys.

3. The process according to claim 1 wherein there are three aluminum bodies and three-phase power potential is imposed between each of said bodies.

4. The process according to claim 1 wherein the AC potential is imposed continuously during oxidation of said bodies.

5. The process according to claim 1 wherein the pH of the electrolyte bath is greater than 7.

6. The process according to claim 5 wherein the electrolyte bath includes a metal hydroxide.

7. The process according to claim 6 wherein the electrolyte bath includes a metal hydroxide, a silicate and an aluminate.

8. The process according to claim 1 further including the step of monitoring changes in current to reflect changes in resistance whereby to monitor increases in the thickness of the oxide coating.

9. The process according to claim 1 further including the step of monitoring changes in color of the microplasma surrounding said bodies to monitor thickness of said oxide coating.

10. The process according to claim 1 wherein the current density applied to the bodies is greater than 10 A/dm$^2$.

11. A process for forming oxide coatings on bodies of aluminum and/or aluminum alloys, said process comprising;

forming an electrolyte bath having a pH above 7 in an inert container;

immersing aluminum and/or aluminum alloy bodies in said bath;

connecting each of said bodies to a side of a single phase AC circuit;

imposing single phase AC power potential within said bath and said bodies;

moving said bodies in said electrolyte bath relative to each other until micro-arcs occur on the surfaces of said bodies, whereby to commence oxidation of said bodies;

continuing the imposition of the potential within said bath until the desired thickness of oxide is formed on said bodies.

12. The process according to claim 11 wherein there are two aluminum bodies and single phase power potential is imposed between each of said bodies.

13. The process according to claim 11 wherein the AC potential is imposed continuously during oxidation of said bodies.

14. The process according to claim 11 wherein the electrolyte bath includes a metal hydroxide.

15. The process according to claim 11 wherein the current density applied to the bodies is greater than 10 A/dm$^2$.

16. A process for forming oxide coatings on at least two bodies of aluminum and/or aluminum alloys, said process comprising;

forming an electrolyte bath in a container;

attaching each of the bodies to an electrode and immersing said bodies in said bath;

connecting each of said electrodes and thus said bodies to a side of a multiphase AC circuit;

imposing multiphase AC power potential between each of said bodies;

moving said bodies in said electrolyte bath relative to each other until micro-arcs occur on the surfaces of said bodies, whereby to commence oxidation of said bodies;

rotating said bodies within said bath during oxidation, whereby to oxidize said bodies with more uniform thicknesses;

continuing the imposition of the potential between each of said bodies until the desired thickness of oxide is formed on said bodies.

17. An electrochemical, microplasmic oxidation process for forming tenacious, stable oxide coatings on bodies of reactive metals, reactive metal alloys, intermetallic compounds, and reactive metal-matrix composites, said process comprising:

forming an electrolytic bath of acidic or basic compositions in a non-reactive metallic, ceramic or plastic container;

immersing two or three metallic bodies, each connected to an electrode, in said bath;

connecting each electrode to a three-phase AC power source;

imposing three-phase AC power potential between each of said bodies;

moving said bodies relative to each other in said electrolyte bath for the purpose of controlling current and current density;

continuing the imposition of the potential between each of said bodies until the desired thickness of oxide has been formed on said bodies.

18. The process according to claim 17 wherein the bodies are made of a reactive metal selected from the group consisting of Al, Mg, Ti, Zr, V, W, and Zn.

19. The process according to claim 17 wherein the bodies are made of a binary reactive metal alloy selected from the group consisting of Al—Cu, Al—Mg, Al—Ti, Al—Zr, Al—V, Al—Zn, Al—Si, and Mg—Zn.

20. The process according to claim 17 wherein the bodies are made of a multi-component reactive metal alloy from the group consisting of Al—Cu—Zn, Al—Cu—Mg, and Al—Mg—Si.

21. The process according to claim 17 wherein the bodies are made of a reactive metal intermetallic compound selected from the group consisting of NiAl, $Ni_3Al$, FeAl, and TiAl.

22. The process according to claim 17 wherein the bodies are made of a reactive metal composite selected from the group consisting of Al—$Al_2O_3$, Mg—$Al_2O_3$, and Ti—$Al_2O_3$.

23. The process according to claim 17 wherein there are two reactive metallic bodies.

24. The process according to claim 17 wherein the AC potential is imposed continuously during oxidation of said bodies.

25. The process according to claim 17 wherein the current density applied to said bodies is greater than 10 $A/dm_2$.

26. The process according to claim 17 wherein the AC potential applied to said bodies is greater than 400 V.

27. The process according to claim 17 wherein the electrolytic bath includes at least one acid selected from the group consisting of sulfuric acid, nitric acid, hydrochloric acid, phosphoric acid, chromic acid, oxalic acid, and combinations thereof.

28. The process according to claim 17 wherein the pH of the bath is between 3 and 6.

29. The process according to claim 17 wherein the electrolytic bath includes sodium, potassium, calcium or magnesium hydroxides, silicates, aluminates, and combinations thereof.

30. The process according to claim 29 wherein the pH of the bath is between 8 and 13.

* * * * *